US006843050B2

(12) United States Patent
Wortmann

(10) Patent No.: US 6,843,050 B2
(45) Date of Patent: Jan. 18, 2005

(54) YARN FALSE TWIST TEXTURING MACHINE

(75) Inventor: Thomas Wortmann, Remscheid (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/422,084

(22) Filed: Apr. 24, 2003

(65) Prior Publication Data

US 2003/0182923 A1 Oct. 2, 2003

Related U.S. Application Data

(63) Continuation of application No. PCT/EP01/12063, filed on Oct. 18, 2001.

(30) Foreign Application Priority Data

Oct. 28, 2000 (DE) ..... 100 53 650

(51) Int. Cl.[7] ..... D01H 13/04
(52) U.S. Cl. ..... 57/280; 57/263
(58) Field of Search ..... 57/112, 127.5, 57/263, 280, 352, 353

(56) References Cited

U.S. PATENT DOCUMENTS

| | | | | |
|---|---|---|---|---|
| 3,837,155 A | | 9/1974 | Lloyd et al. | |
| 4,106,275 A | * | 8/1978 | Fitzner et al. | 57/280 |
| 4,170,103 A | | 10/1979 | Norris et al. | |
| RE30,159 E | * | 11/1979 | Kubler | 57/291 |
| 4,354,343 A | * | 10/1982 | D'Agnolo et al. | 57/279 |
| 5,079,908 A | * | 1/1992 | Stahlecker | 57/261 |
| 5,431,002 A | | 7/1995 | Treptow | |
| 5,475,909 A | * | 12/1995 | Heil et al. | 28/272 |
| 5,644,908 A | | 7/1997 | Schippers et al. | |
| 6,301,870 B1 | | 10/2001 | Bunger et al. | |
| 6,494,029 B2 | * | 12/2002 | Jaschke et al. | 57/280 |

FOREIGN PATENT DOCUMENTS

| | | |
|---|---|---|
| DE | 198 34 429 A1 | 2/1999 |
| EP | 0 595 086 B1 | 5/1994 |
| GB | 2 306 176 A | 4/1997 |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A yarn false twist texturing machine for texturing multifilament synthetic yarns (4), wherein a heating device and a false twist unit are arranged within a false twist zone. An aftertreatment zone accommodates a second heating device and a countertwist device. The countertwist device is used to remove any residual twist that is left in the yarn by the false twist unit. To be able to perform a selective treatment by the countertwist device, a first embodiment provides for a twist imparting member yarn guide means for guiding the yarn (4) and being adapted for reciprocal movement between an idle position for not treating the yarn (4) or for threading it and an operating position for treating the yarn (4). In a second embodiment, the countertwist device comprises a movable twist imparting member (28, 29), which is adapted for reciprocal movement between an idle position for not treating or for threading the yarn (4) and an operating position for treating the yarn (4) by twisting it.

14 Claims, 4 Drawing Sheets

YARN FALSE TWIST TEXTURING MACHINE

CROSS REFERENCE TO RELATED APPLICATION

This is a continuation of international application PCT/EP01/12063, filed Oct. 18, 2001, the disclosure of which is incorporated herein by reference.

BACKGROUND OF THE INVENTION

The invention relates to a false twist texturing machine for texturing a plurality of thermoplastic multifilament yarns.

A false twist texturing machine of this general type is disclosed, for example, in U.S. Pat. No. 5,644,908. The false twist texturing machine as described in that patent comprises a plurality of processing stations, each of which produces a crimped yarn from a fed flat yarn. To this end, a first feed system withdraws the yarn from a feed yarn package and advances it into a false twist zone. The false twist zone includes a heating device, a cooling device, and a false twist unit mounted in series. Within the false twist zone, the yarn undergoes a drawing and setting. The false twist unit produces a twist, which extends opposite to the direction of the advancing yarn, so that within the cooling device and the heating device, in which the yarn undergoes thermal treatment, the yarn exhibits a false twist, which is removed at the outlet of the false twist unit.

For a thermal aftertreatment, a second feed system advances the yarn through a second heater as well as to a takeup device, which winds the yarn to a package. Since after removing the false twist, a greater or lesser residual twist remains in the yarn as a function of the process, the known texturing machine includes a countertwist device in the form of an entanglement nozzle upstream of the takeup device. The countertwist device leads to a twist treatment, which removes the residual twist in the yarn.

Whether or not, and the extent a twist treatment by the countertwist device is needed, depends both on the polymer type of the yarn and on the adjusted process parameters, for example, the yarn speed.

Furthermore, for increasing the effectiveness of the twist treatment, it is known from WO99/09239 and corresponding U.S. Pat. No. 6,301,870 to arrange the countertwist device directly in the outlet region of the second heating device, so as to enable a well defined setting of the yarn in the heating device and, with that, a destruction of the residual twist. However, in so doing, one should consider that such heating devices, as disclosed, for example, in EP 0 595 086 B1 and corresponding U.S. Pat. No. 5,431,002, often cooperate with a guide tube for a thermal adjustment or for threading the yarn. Thus, for threading the yarn, the guide tube is connected to an injector, so that the yarn is taken in by suction at the inlet of the heating device, and so that it is advanced via the guide tube to a predetermined position within the machine.

It is therefore an object of the invention to provide the initially described false twist texturing machine with a countertwist device, which is easy to use when a twist treatment is needed, and which does not interfere with a pneumatic threading of the yarn at the beginning of a process.

SUMMARY OF THE INVENTION

In accordance with the invention, the above and other objects and advantages of the invention are achieved by the provision of a yarn false twist texturing machine of the described type and wherein a yarn countertwist device is positioned in the yarn path of travel between the second heating device and the winding device, with the countertwist device comprising a twist imparting member that cooperates with a yarn guide means.

The invention distinguishes itself in that it permits adapting the guidance of the yarn in the countertwist device to respective needs. In this connection, the invention offers a first variant, in which the position of the yarn advance is variable, and a second variant, in which the position of the yarn advance remains unchanged. In the first variant, a twist imparting member of the countertwist device cooperates with a guide means which guides the advancing yarn, and which is adapted for reciprocating between an idle position and an operating position. In the idle position, the yarn is guided in such a manner that it is separated from the twist imparting member and undergoes no twist treatment. This position is thus also well suited for threading the yarn. Only when the guide means is in its operating position, will the twisting device treat the yarn.

In the second variant, which is based on the same fundamental concept, the yarn advance within the machine remains substantially unchanged. To this end, the countertwist device includes a movable twist imparting member, which is likewise adapted for reciprocal movement between an idle position and an operating position. In the idle position, the yarn undergoes no twist treatment. Only when the twist imparting member is moved to its operating position, will it be possible to treat the yarn by twisting it.

As a twist imparting member, it is possible to use, for example, rolls or guide edges, over which the yarn advances obliquely for receiving a twist treatment. It is especially preferred to realize the twist imparting member as an entanglement nozzle. In this instance, the entanglement nozzle comprises a yarn channel for guiding the yarn. In this channel, a tangentially entering air flow produces the twist on the yarn. The yarn channel communications with a continuous threading slot, which permits inserting the yarn from the outside into the yarn channel. With that, it is possible to advance the yarn both by the guide means and by the entanglement nozzle itself, inside the yarn channel in the operating position and outside the yarn channel in the idle position.

In a particularly advantageous further development of the invention, the entanglement nozzle comprises a piston that is movable transversely to the yarn advance, and adjustable within a housing between the idle position and the operating position. In the transverse direction of its longitudinal axis, the piston includes both the yarn channel with the threading slot and a nozzle bore terminating in the yarn channel. The housing includes a yarn inlet, and a yarn outlet opposite thereto, as well as a compressed air connection. In the operating position of the piston, the yarn channel interconnects the yarn inlet and the yarn outlet. Likewise, the nozzle bore is coupled with the compressed air connection, so that a twist treatment on the yarn occurs within the yarn channel.

To interrupt the treatment of the yarn, or to enable a threading of the yarn through the yarn inlet and yarn outlet, it is especially advantageous to construct the threading slot that connects to the yarn channel, with a V-shaped cross section at one front end of the piston. Thus, the movement of the piston between the operating position and the idle position makes it possible to guide the yarn advancing between the yarn inlet and the yarn outlet, automatically through the threading slot into or out of the yarn channel.

To interrupt the supply of compressed air to the entanglement nozzle, an advantageous further development of the invention proposes to close the compressed air connection in the housing by a control surface of the piston. In so doing, the control surface of the piston is guided by the movement of the piston to the idle position in the region of the compressed air connection.

Another preferred further development of the invention is especially suited for automatically threading the yarn. In this development, both the yarn inlet of the housing and the yarn outlet of the housing each mount a guide tube. For threading the yarn, it is possible to connect an injector to one of the guide tubes, so that the yarn can be pneumatically threaded in a simple manner, while the piston is in its idle position. Advantageously, the guide tube arranged at the yarn inlet of the entanglement nozzle is coupled directly with the outlet of a set heater.

The movement of the guide means or the movement of the twist imparting member is preferably controlled by an actuator. The actuator may be activated directly by an operator or via a control device.

In the false twist texturing machine, the false twist unit may impart to the yarn a so-called Z-twist or an S-twist. To be able to use the countertwist device arranged upstream of the takeup device both for the Z-twist and for the S-twist, it will be of particular advantage, when the twist imparting member is made exchangeable, so as to enable a twist treatment that is selectively applied against the S-twist or against the Z-twist.

BRIEF DESCRIPTION OF THE DRAWINGS

In the following, two embodiments of the yarn false twist texturing machine according to the invention are described in greater detail with reference to the attached drawings, in which.

DETAILED DESCRIPTION OF THE PREFERRED EMBODIMENTS

Figure 1:
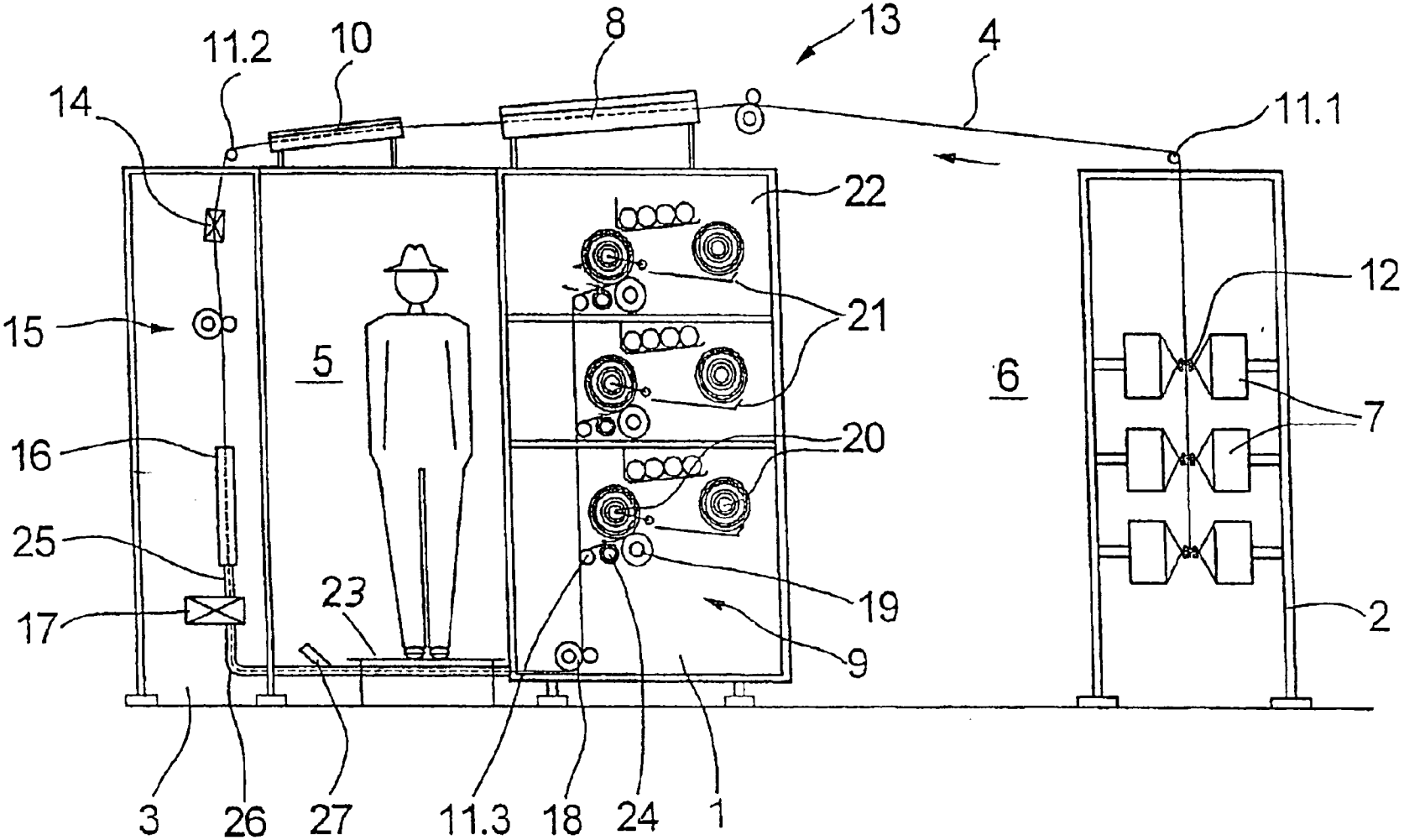
FIG. 1 is a schematic view of a yarn false twist texturing machine which embodies the invention.

FIG. 1 schematically illustrates an embodiment of a yarn false twist texturing machine according to the invention. The yarn false twist texturing machine comprises a creel frame 2, a processing frame 3, and a takeup frame 1. A service aisle 5 is formed between the processing frame 3 and the takeup frame 1. On the side of the takeup frame 1 opposite to the service aisle 5, the creel frame 2 extends in spaced relationship with the takeup frame 1. Between the takeup frame 1 and the creel frame 2, a doffing aisle 6 is formed. The takeup frame 1 accommodates three takeup devices 9, one overlying the other, which are part of each processing station of the machine. In each processing station, a first delivery system 13 withdraws, via a yarn guide 12 and a first deflection roll 11.1, a yarn 4 from a supply yarn package 7 arranged in the creel frame 2. From the first delivery system 13, the yarn advances into a false twist zone, which comprises a heating device 8, a cooling device 10, a second deflection roll 11.2, and a false twist unit 14. Subsequently, a second delivery system 15 withdraws the yarn 4 from the false twist zone and advances it to a second heating device 16. In this process, the speed of the yarn is adjusted by a third delivery system 18 downstream of the second heating device 16.

A countertwist device 17 is arranged between the second heating device 16, herein referred to as a set heater, and the third delivery system 18. For guiding the yarn, the countertwist device 17 mounts on its inlet side and its outlet side respectively a first guide tube 25 and a second guide tube 26. Upstream of the countertwist device 17, the first guide tube 25 is coupled with the outlet of the set heater 16. An injector 27 connects to the second guide tube 26, which extends below a platform 23 of the service aisle 5. The second guide tube 26 ends directly upstream of the third feed system 18.

The third delivery system 18 advances the yarn 4 to the takeup device 9 via a third deflection roll 11.3. The takeup device 9 comprises a friction roll 19 for driving a package 20 while being wound, a yarn traversing device 24 upstream of the friction roll 19, a storage 21 serving to receive full packages, as well as a tube magazine 22. In the takeup device 9, the yarn 4 is wound to a package 20.

In the embodiment of the false twist texturing machine as shown in FIG. 1, the delivery system 13 withdraws the yarn 4 from the supply yarn package 7 and advances it into the false twist zone. The false twist is imparted to the yarn 4 by the false twist unit 14. The thus-produced false twist returns against the direction of the advancing yarn to the first delivery system 13 or the first deflection roll 11.1, which could be constructed as a twist stop roll. Thus, the yarn advances in a false twisted condition through the first heating device 8 into the cooling device 10. In its twisted condition, the yarn is drawn and set in the heating device 8, which leads to a setting of the twist and thus to a satisfactory crimp result in the yarn 4.

After the yarn 4 has left the false twist zone, it exhibits a greater or lesser residual twist. Such a residual twist, which causes the yarn 4 to turn about itself, however, is undesired for a subsequent further processing. Consequently, the countertwist device 17 imparts to the yarn a countertwist, which is opposite in its direction to that of the false twist. This countertwist propagates as far back as the second feed system 15. Since the countertwist acts against the residual twist, the setting and the relaxation treatment in set heater 16 lead to a twistfree yarn 4. In this process, the countertwist device is in an operating position, as is described in greater detail in the following.

Figure 2:
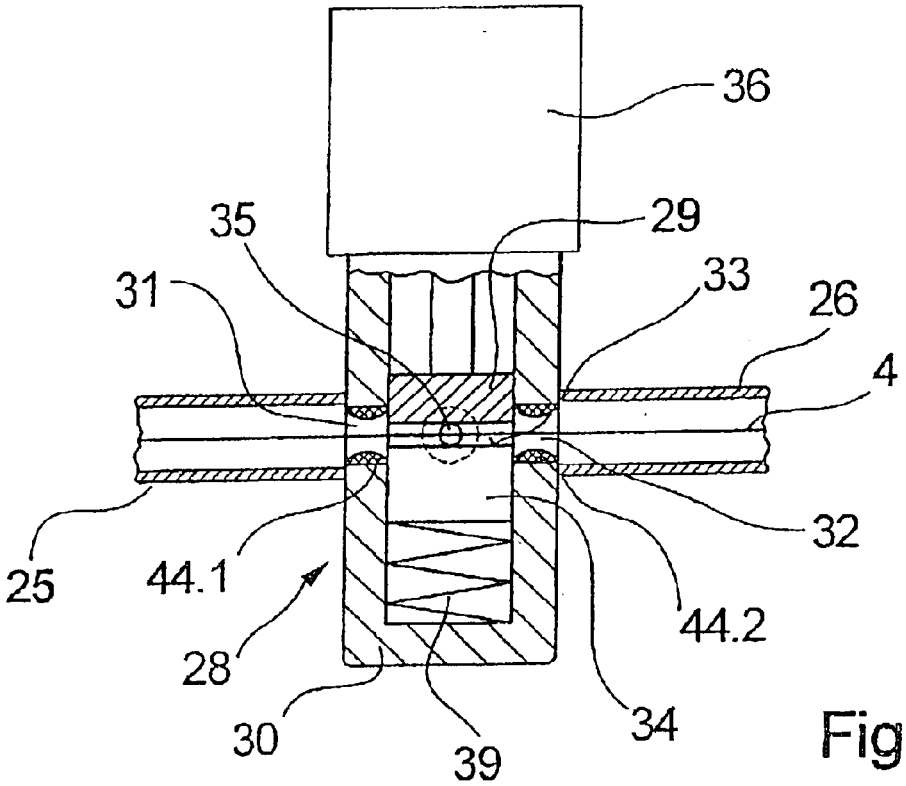
FIG. 2 is a longitudinally sectioned view parallel to the direction of movement of the yarn showing the countertwist device of the false twist texturing machine shown in FIG. 1 in its operating position.
Figure 3:
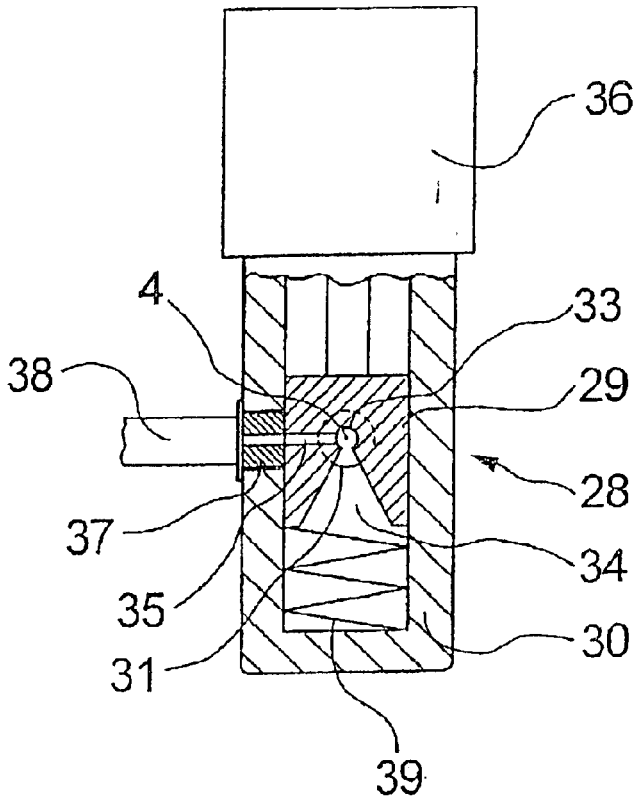
FIG. 3 is a sectional view transverse to the direction of movement of the yarn showing the countertwist device of the false twist texturing machine shown in FIG. 1 in its operating position.
Figure 4:
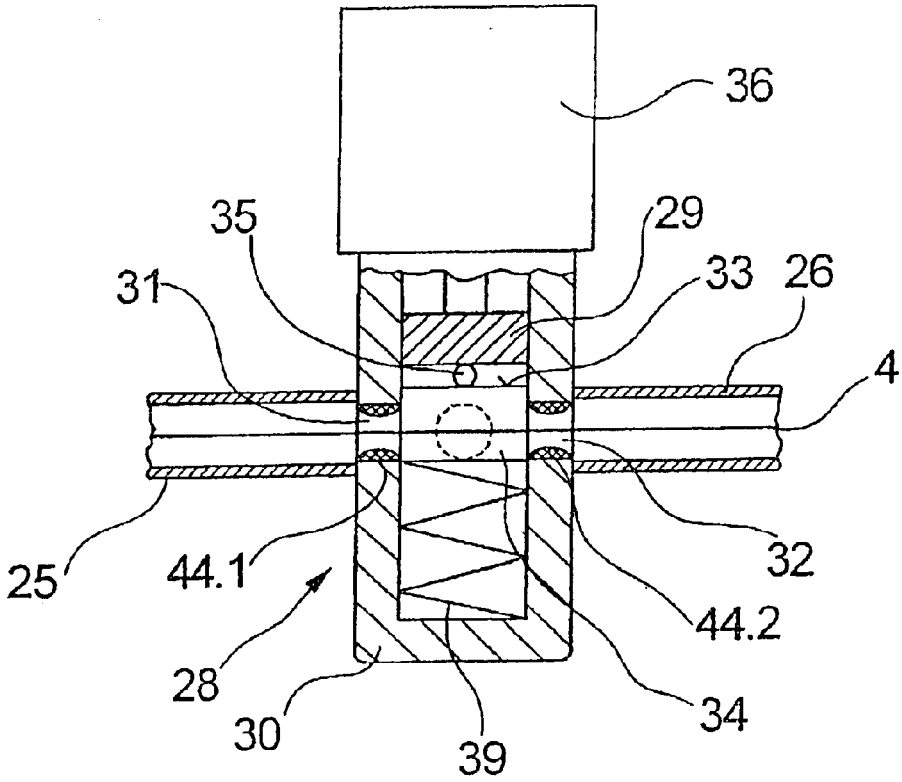
FIG. 4 is a longitudinally sectioned view parallel to the direction of movement of the yarn showing the countertwist device of the false twist machine shown in FIG. 1 in its idle position.
Figure 5:
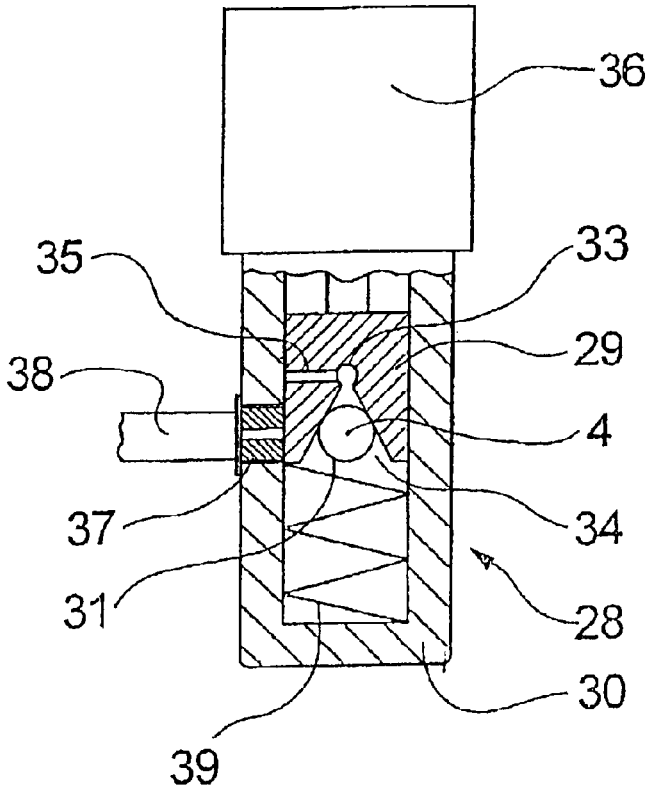
FIG. 5 is a sectional view transverse to the direction of movement of the yarn showing the countertwist device of the false twist texturing machine shown in FIG. 1 in its idle position.

The countertwist device 17 is schematically illustrated in FIGS. 2–5. While FIGS. 2 and 3 show the countertwist 17 in an operating position, FIGS. 4 and 5 show it in an idle position. The following description will apply to FIGS. 2–5, unless express reference is made to one of the Figures.

FIGS. 2 and 3 show the countertwist device in its operating position, with the countertwist device being shown in a longitudinally sectioned view parallel to the yarn advance (FIG. 2), and in a cross sectional view transverse to the yarn advance (FIG. 3). As a twist imparting member, the countertwist device includes an entanglement nozzle 28. To this end, the entanglement nozzle 28 comprises a piston 29, which extends in a cylindrical housing 30 in the transverse direction of the yarn advance. In a plane of the advancing yarn, the housing 30 has on its one side a yarn inlet 31 and on its opposite side a yarn outlet 32. The yarn inlet 31 and yarn outlet 32 include respectively an inlet yarn guide 44.1 and an outlet yarn guide 44.2. In concentric relationship with the yarn inlet 31, the housing mounts on its outside the first guide tube 25. On the opposite side, the second guide tube 26 connects to the housing 30 at the height of the yarn outlet 32. Between the yarn inlet 31 and the yarn outlet 32, the piston 29 extends in the housing 30.

In the transverse direction of its longitudinal axis, the piston 29 includes a continuous yarn channel 33, which connects the yarn inlet 31 to the yarn outlet 32. The yarn channel 33 includes a continuous threading slot 34, which has a V-shaped opening cross section in the direction of movement of the piston 29. To this end, the threading slot 34 is provided in the lower front end of the piston 29. At its opposite front end, the piston 29 connects to an actuator 36.

In a transverse direction of the yarn channel 33, the piston 29 is provided with a nozzle bore 35, which terminates with its one end in the yarn channel 33 and connects with its other end to a pressure line 38, which is joined to the housing 30 via a compressed-air connection 37.

In FIGS. 2 and 3, the entanglement nozzle 28 is shown in its operating position. In this situation, the piston 29 is held in its position by the actuator 36 and a spring 39, which is operative on the lower front end of the piston 29, and which is supported on the base of the closed housing 30. The yarn 4 enters the yarn channel 33 via yarn inlet 31. Inside the yarn channel 33, compressed air enters in a substantially tangential relationship through the nozzle bore 35, and acts upon the yarn 4 to produce a countertwist. This countertwist propagates as far back as the feed system 15. The yarn 4 leaves the entanglement nozzle 28 via the yarn outlet 32, and advances through the second guide tube 26 to the third feed system 18.

In cases wherein no twist treatment of the yarn 4 by the countertwist device 17 is desired, the actuator 36 is activated for moving the piston 29. Subsequently, the piston 29 is moved in the transverse direction of the yarn advance, to its idle position within the housing 30. This situation is shown in FIGS. 4 and 5. In this connection, FIG. 4 is a longitudinally sectioned view of the entanglement nozzle 28 parallel to the plane of the advancing yarn, and FIG. 5 is a cross sectional view thereof in the transverse direction of the yarn advance. In this situation, the piston 29 is displaced such that the yarn inlet 31 and the yarn outlet 32 are interconnected via a large opening cross section of the threading slot 34. The yarn channel 33 is removed from the advancing yarn. At the same time, a control surface of the piston 29 closes the compressed-air connection 37, note FIG. 5, thereby preventing additional compressed air from entering the interior of the housing 30. In the idle position, the piston 29 is held by the actuator 36 and spring 39.

The situation of the entanglement nozzle 28 shown in FIGS. 4 and 5, is in particular also suited for enabling an automatic threading of the yarn 4. As previously shown in FIG. 1, the outlet of set heater 16 connects to the first 25 and the second guide tube 26. The first guide tube 25 and the second guide tube 26 surround respectively the yarn inlet 31 and the yarn outlet 32. Connected to the second guide tube 26 is the injector 27, which is biased with compressed air for threading the yarn 4. In this process, a vacuum for taking in the yarn 4 by suction is generated both in the tube section upstream of the injector 27 and in the set heater 16. This makes it possible to guide the yarn through the set heater 16, into the first guide tube 25, to the yarn inlet 31 of the entanglement nozzle 28. Based on the large opening cross section within the entanglement nozzle 28, the yarn is sucked into the second guide tube 26 directly via the yarn outlet 32. Subsequently, it is possible to take over the yarn at the outlet of the second guide tube 26, a short distance upstream of the third feed system 18.

After the yarn 4 has been threaded in the machine, it will be possible to guide the piston 29 by means of the actuator 36 to the operating position within the housing 30, when a treatment by the countertwist device is needed.

In this process, the yarn 4 advancing between the yarn inlet 31 and the yarn outlet 32, automatically slides via the threading slot 34 into the yarn channel 33. At the same time, the nozzle bore 35 is coupled with the lateral compressed-air connection 37. Compressed air is allowed to enter, so that it is possible to perform a corresponding treatment of the yarn 4.

Figure 6:
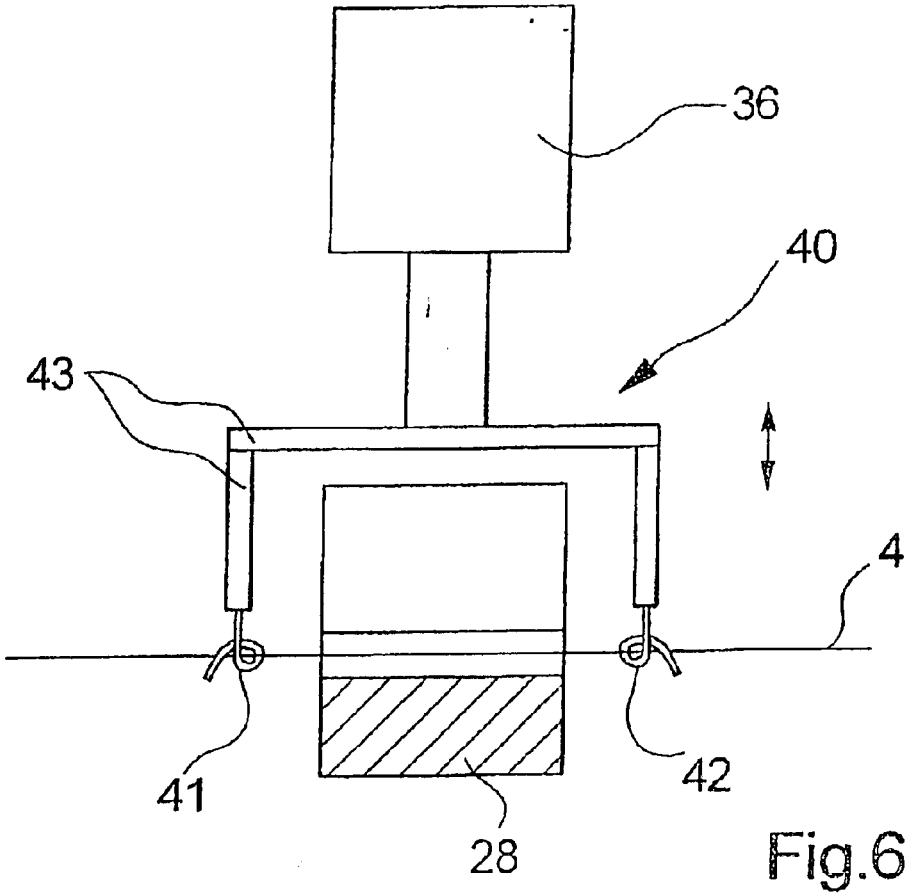
FIG. 6 is a longitudinally sectioned view parallel to the yarn advance showing a further embodiment of an entanglement nozzle.
Figure 7:
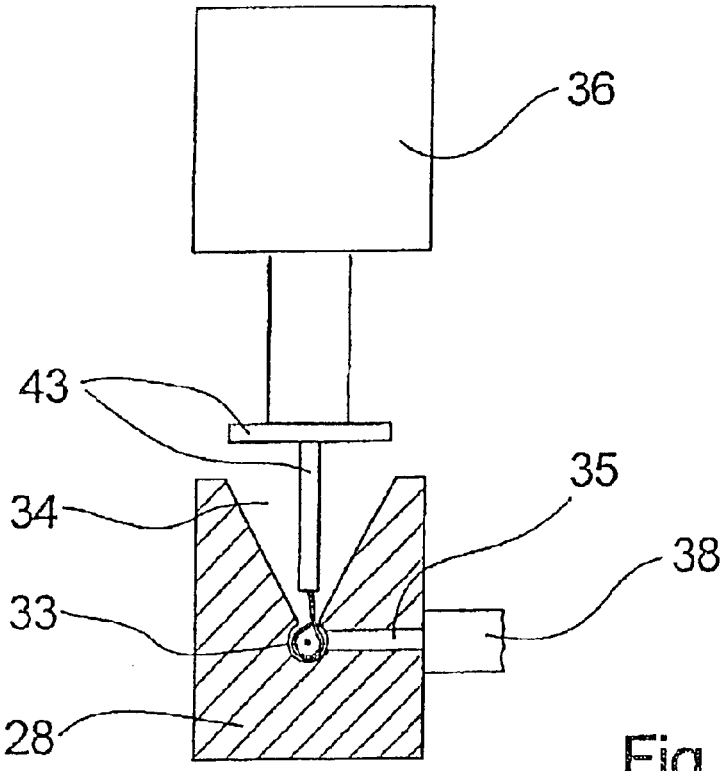
FIG. 7 is a sectional view transverse to the yarn advance showing an entanglement nozzle of FIG. 6.

FIGS. 6 and 7 illustrate a further embodiment of a countertwist device, which is used in particular in false twist texturing machines, wherein a manual operation is performed.

In this embodiment of the countertwist device, an entanglement nozzle 28 is provided as the twist imparting member. FIG. 6 illustrates a longitudinally sectioned view of the entanglement nozzle parallel to the yarn advance, and FIG. 7 is a cross sectional view thereof in the transverse direction of the yarn advance. The following description will apply to both Figures.

The entanglement nozzle 28 includes a continuous yarn channel 33. Toward one side, the yarn channel 33 connects without interruption to a threading slot 34. The threading slot 34 has a V-shaped opening cross section. In the transverse direction of the yarn channel 33, a nozzle bore 35 is provided, which connects to a pressure line 38.

A guide means 40 is associated with the entanglement nozzle 28. The guide means 40 comprises a support 43 as well as a first yarn guide 41 in the yarn path upstream of the yarn channel 33 and a second yarn guide 42 in the yarn path downstream of the yarn channel 33. These two yarn guides 41, 42 are mounted to the support 43. The guide means 40 connects to an actuator 36. The actuator permits adjusting the guide means 40 in its location between an operating position as shown, and an idle position not shown. In the operating position, the yarn guides 41 and 42 guide the yarn 4 through the yarn channel 33. In this situation, the yarn 4 undergoes a twist treatment.

In the case that no twist treatment is desired, the actuator 36 will be activated, so that the guide means 40 is moved such that the yarn guides 41 and 42 are guided into the region of the threading slot 34. In so doing, the yarn 4 is automatically removed from the yarn channel 33.

In the case of the countertwist device shown in FIGS. 6 and 7, the twist imparting member could also be formed by a roll, which extends in oblique relationship with the advancing yarn. In this connection, the guide means 40 would establish a contact between the yarn 4 and the roll in the operating situation. In the case that no treatment is desired, the guide means may be moved to discontinue the contact between the yarn 4 and the roll.

What is claimed is:

1. A yarn false twist texturing machine for texturing a multifilament synthetic yarn comprising a feed yarn supply, a first delivery device, a first heating device, a cooling device, a false twist unit, a second delivery device, a second heating device, a third delivery device, and a winding device serially arranged along a yarn path of travel, a yarn countertwist device positioned in the yarn path between the second heating device and the winding device, said countertwist device comprising a twist imparting member cooperating with a yarn guide means for imparting twist to the yarn in a direction opposite to that imparted by the false twist unit and so as to produce an essentially twist-free yarn, and means including an actuator for selectively and positively moving the twist imparting member or the yarn guide means in each direction between (a) an operating position wherein a countertwist is imparted to the advancing yarn and (b) an idle position wherein the twist imparting member is separated from the advancing yarn so as to not impart a countertwist to the advancing yarn and to facilitate its threadup.

2. The yarn false twist texturing machine of claim 1 wherein the twist imparting member comprises an entanglement nozzle which includes a yarn channel with a continuous threading slot for inserting the yarn, and so that in the operative position the yarn advances within the yarn channel and in the idle position the yarn advances outside the yarn channel.

3. The yarn false twist texturing machine of claim 2, wherein the entanglement nozzle includes a movable piston which is adapted for displacement inside a housing between the idle position and the operating position, with the piston including the yarn channel with the threading slot that extends in a direction transverse to the longitudinal axis of the piston, and a nozzle bore terminating in the yarn channel, and wherein the housing comprises a yarn inlet and a yarn outlet opposite to the yarn inlet, and a compressed air connection, and that in the operating position of the piston, the yarn channel connects to the yarn inlet and the yarn outlet, and the nozzle bore connects to the compressed air connection.

4. The yarn false twist texturing machine of claim 3, wherein the threading slot is made with a V-shaped cross section at a front end of the piston, so that during the movement of the piston from the idle position to the operating position, the yarn advancing between the yarn inlet and the yarn outlet automatically slides through the threading slot and into the yarn channel.

5. The yarn false twist texturing machine of claim 4, wherein in the idle position of the piston, the compressed-air connection in the housing is closed by a control surface of the piston.

6. The yarn false twist texturing machine of claim 5, wherein the housing with the yarn inlet and the yarn outlet is arranged between a first guide tube and an opposite second guide tube, and that for threading the yarn at least one injector is connected to the second guide tube.

7. The yarn false twist texturing machine of claim 1, wherein the countertwist device is arranged between the outlet of the second heating device and the third delivery device.

8. The yarn false twist texturing machine of claim 1, wherein the twist imparting member is made exchangeable for selectively producing an S-twist or a Z-twist.

9. A yarn false twist texturing machine for texturing a multifilament synthetic yarn comprising a feed yarn supply, a first delivery device, a first heating device, a cooling device, a false twist unit, a second delivery device, a second heating device, a third delivery device, and a winding device serially arranged along a yarn path of travel, a yarn countertwist device positioned in the yarn path between the second heating device and the winding device, said countertwist device comprising a twist imparting member cooperating with a yarn guide means for imparting twist to the yarn in a direction opposite to that imparted by the false twist unit and so as to produce an essentially twist-free yarn, means mounting the twist imparting member for selective movement between (a) an operating position wherein a countertwist is imparted to the advancing yarn and (b) an idle position wherein the twist imparting member is separated from the advancing yarn so as to not impart a countertwist to the advancing yarn and to facilitate its threadup, and an actuator which is configured to selectively and positively move the twist imparting member in each direction between the operating and idle positions.

10. A yarn false twist texturing machine for texturing a multifilament synthetic yarn comprising a feed yarn supply, a first delivery device, a first heating device, a cooling device, a false twist unit, a second delivery device, a second heating device, a third delivery device, and a winding device serially arranged along a yarn path of travel, a yarn countertwist device positioned in the yarn path between the second heating device and the winding device, said countertwist device comprising a twist imparting member cooperating with a yarn guide means for imparting twist to the yarn in a direction opposite to that imparted by the false twist unit and so as to produce an essentially twist-free yarn, and means mounting the yarn guide means for selective movement between (a) an operating position wherein a countertwist is imparted to the advancing yarn and (b) an idle position wherein the advancing yarn is separated from the twist imparting member so as to not impart a countertwist to the advancing yarn and to facilitate its threadup.

11. A yarn false twist texturing machine for texturing a multifilament synthetic yarn comprising a feed yarn supply, a first delivery device, a first heating device, a cooling device, a false twist unit, a second delivery device, a second heating device, a third delivery device, and a winding device serially arranged along a yarn path of travel, a yarn countertwist device positioned in the yarn path between the second heating device and the winding device, said countertwist device comprising a twist imparting member cooperating with a yarn guide means for imparting twist to the yarn in a direction opposite to that imparted by the false twist unit and so as to produce an essentially twist-free yarn, means for selectively moving the twist imparting member or the yarn guide means between (a) an operating position wherein a countertwist is imparted to the advancing yarn and (b) an idle position wherein the twist imparting member is separated from the advancing yarn so as to not impart a countertwist to the advancing yarn and to facilitate its threadup, wherein the twist imparting member comprises an entanglement nozzle which includes a yarn channel with a continuous threading slot for inserting the yarn, and so that in the operative position the yarn advances within the yarn channel and in the idle position the yarn advances outside the yarn channel, and wherein the entanglement nozzle includes a movable piston which is adapted for displacement inside a housing between the idle position and the operating position, with the piston including the yarn channel with the threading slot that extends in a direction transverse to the longitudinal axis of the piston, and a nozzle bore terminating in the yarn channel, and wherein the housing comprises a yarn inlet and a yarn outlet opposite to the yarn inlet, and a compressed air connection, and that in the operating position of the piston, the yarn channel connects to the yarn inlet and the yarn outlet, and the nozzle bore connects to the compressed air connection.

12. The yarn false twist texturing machine of claim 11, wherein the threading slot is made with a V-shaped cross section at a front end of the piston, so that during the movement of the piston from the idle position to the operating position, the yarn advancing between the yarn inlet and the yarn outlet automatically slides through the threading slot and into the yarn channel.

13. The yarn false twist texturing machine of claim 12, wherein in the idle position of the piston, the compressed-air connection in the housing is closed by a control surface of the piston.

14. The yarn false twist texturing machine of claim 13, wherein the housing with the yarn inlet and the yarn outlet is arranged between a first guide tube and an opposite second guide tube, and that for threading the yarn at least one injector is connected to the second guide tube.

* * * * *